US005650820A

United States Patent [19]

Sekine et al.

[11] Patent Number: 5,650,820

[45] Date of Patent: Jul. 22, 1997

[54] HAND RECORDING APPARATUS AND MOVEMENT GUIDE THEREFOR

[75] Inventors: Kazumi Sekine, Kawasaki; Noboru Koumura, Narashino; Toshiaki Harada, Kawasaki; Ryozo Yanagisawa, Matsudo, all of Japan

[73] Assignee: Canon Kabushiki Kaisha, Tokyo, Japan

[21] Appl. No.: 593,476

[22] Filed: Jan. 29, 1996

Related U.S. Application Data

[63] Continuation of Ser. No. 502,581, Jul. 14, 1995, abandoned, which is a continuation of Ser. No. 348,194, Nov. 28, 1994, abandoned, which is a continuation of Ser. No. 100,189, Aug. 2, 1993, abandoned, which is a continuation of Ser. No. 931,663, Aug. 19, 1992, abandoned, which is a continuation of Ser. No. 489,856, Mar. 2, 1990, abandoned, which is a continuation of Ser. No. 168,387, Mar. 15, 1988, abandoned.

[30] Foreign Application Priority Data

| | | | |
|---|---|---|---|
| Mar. 19, 1987 | [JP] | Japan | 62-62480 |
| Apr. 9, 1987 | [JP] | Japan | 62-52794 U |
| Apr. 13, 1987 | [JP] | Japan | 62-88616 |

[51] Int. Cl.[6] ..... B41J 2/435

[52] U.S. Cl. ..... 347/263; 358/497; 346/139 R

[58] Field of Search ..... 347/263, 262, 347/264; 346/139 R; 358/497, 484, 488

[56] References Cited

U.S. PATENT DOCUMENTS

| | | | |
|---|---|---|---|
| 4,297,039 | 10/1981 | Lees | 400/120 |
| 4,343,012 | 8/1982 | Knapp | 346/139 R |
| 4,528,754 | 7/1985 | Houldsworth | 346/137 R |
| 4,553,035 | 11/1985 | Malinsky et al. | 358/473 |
| 4,611,246 | 9/1986 | Nihei | 346/143 |
| 4,652,937 | 3/1987 | Shimura | 358/293 |
| 4,684,998 | 8/1987 | Tanioka | 358/473 |
| 4,736,211 | 4/1988 | Sieber | 346/139 R |
| 4,772,954 | 9/1988 | Shin | 358/293 |
| 4,831,459 | 5/1989 | Kimura | 358/473 |

FOREIGN PATENT DOCUMENTS

| | | |
|---|---|---|
| 5040289 | 12/1975 | Japan . |
| 59-114074 | 6/1984 | Japan . |
| 59-145166 | 8/1984 | Japan . |
| 1366253 | 9/1974 | United Kingdom . |

*Primary Examiner*—Mark J. Reinhart

*Attorney, Agent, or Firm*—Fitzpatrick, Cella, Harper & Scinto

[57] ABSTRACT

A movement guide for guiding the movement of a manually movable hand recording apparatus has a guide member for guiding the movement of the hand recording apparatus, and an engaging portion provided on the guide member and removably engageable with the hand recording apparatus when the movement of the hand recording apparatus is guided.

15 Claims, 16 Drawing Sheets

HAND RECORDING APPARATUS AND MOVEMENT GUIDE THEREFOR

This application is a continuation of application Ser. No. 08/502,581, filed Jul. 14, 1995, which is a continuation of application Ser. No. 08/348,194, filed Nov. 28, 1994, which is a continuation of application Ser. No. 08/100,189, filed Aug. 2, 1993, which is a continuation of application Ser. No. 07/931,663, filed Aug. 19, 1992, which is a continuation of application Ser. No. 07/489,856, filed Mar. 2, 1990, which is a continuation of application Ser. No. 07/168,387, filed Mar. 15, 1988, all now abandoned.

BACKGROUND OF THE INVENTION

1. Field of the Invention

This invention relates to a hand recording apparatus manually operated to effect image recording on a recording medium and to a movement guide for moving the hand recording apparatus properly in a predetermined direction.

Herein, the hand recording apparatus is a recording apparatus which effects image recording on a recording medium (such as, for example, plain paper, cloth or a plastic sheet) while being manually moved by the operator. The hand recording apparatus covers an apparatus connected to a main apparatus (for example, a word processor or a typewriter) to effect image recording in conformity with image information from the main apparatus, and an apparatus having in itself an image information input mechanism. The images include, for example, characters, numerals, patterns and figures.

2. Related Background Art

Nowadays, word processors and the like are widely popular, and as the output apparatuses of these word processors and the like, there are heat transfer type recording apparatuses using an ink ribbon.

The construction of the heat transfer type recording apparatus is such that a recording head adapted to generate heat in response to an image signal is carried on a movable carriage. The carriage is moved by a motor and the recording head is drivingly controlled so as to be synchronized with the movement of the carriage. The ink of the ink ribbon is melted in the form of an image pattern, which is transferred to a recording medium such as recording paper. It is the usual practice to repeat such a printing operation for each line to thereby accomplish recording.

The above-described heat transfer type recording apparatus is compact and light in weight and produces only low noise and therefore is widely used as the output apparatus of a word processor or the like.

The above-described recording apparatus has a feed mechanism for the carriage, a recording paper feeding mechanism, etc. and is therefore complex in structure, and the thickness, size, etc. of recording paper on which recording can be effected is limited. That is, there has been the problem that it is difficult to effect recording on paper thicker than a predetermined thickness or larger than a predetermined size.

So, there has heretofore been proposed a recording apparatus whose body can be manually scanned (Japanese Patent Publication No. 40289/1975). This recording apparatus is such that it is placed on recording paper and manually moved thereon and a recording head is driven so as to be synchronized with the movement speed of the apparatus, thereby accomplishing recording. This recording apparatus can effect recording even on booklet-like recording paper and can be made compact.

However, the manually scanned recording apparatus does not have a recording paper feeding mechanism and a guide mechanism for guiding the movement of the apparatus body and is therefore liable to move in a zigzag direction when the apparatus body is manually moved.

Accordingly, it is difficult to maintain the inter-line space constant when recording a writing over several lines, and further, there has been the problem that it is also difficult to accurately record enlarged characters or symbols over several lines.

SUMMARY OF THE INVENTION

It is an object of the present invention to provide a hand recording apparatus which is capable of recording clear-cut images on a recording medium and a movement guide for such hand recording apparatus.

It is another object of the present invention to provide a hand recording apparatus which is capable of accomplishing image recording on a recording medium while being manually moved by the operator and a movement guide for such hand recording apparatus.

It is still another object of the present invention to provide a hand recording apparatus which can be moved accurately in a predetermined direction and a movement guide for such hand recording apparatus.

It is yet still another object of the present invention to provide a hand recording apparatus which can maintain the inter-line space constant when recording a writing over several lines and a movement guide for such hand recording apparatus.

It is a further object of the present invention to provide a hand recording apparatus which is capable of accurately recording images such as enlarged characters or symbols over several lines and a movement guide for such hand recording apparatus.

DESCRIPTION OF THE PREFERRED EMBODIMENTS

The present invention will hereinafter be described in detail with reference to the drawings.

Description will first be made of an example of a hand recording apparatus to which the present invention is applicable.

A hand recording apparatus to be described is provided with detecting means for detecting the amount of movement of the apparatus body on a recording medium, conveying means for conveying a transfer medium in response to the movement of said apparatus body, and a recording head for driving said transfer medium so as to be transferred to said recording medium correspondingly to the movement of said apparatus in response to an image signal.

When the apparatus body is manually or otherwise moved, the detecting means detect the amount and speed of movement of the apparatus body. In conformity with the result of this detection, the transfer medium is conveyed and the recording head is driven, whereby predetermined image recording is effected on the recording medium.

An embodiment to which said means are applied will now be described with reference to the drawings.

Figure 1:
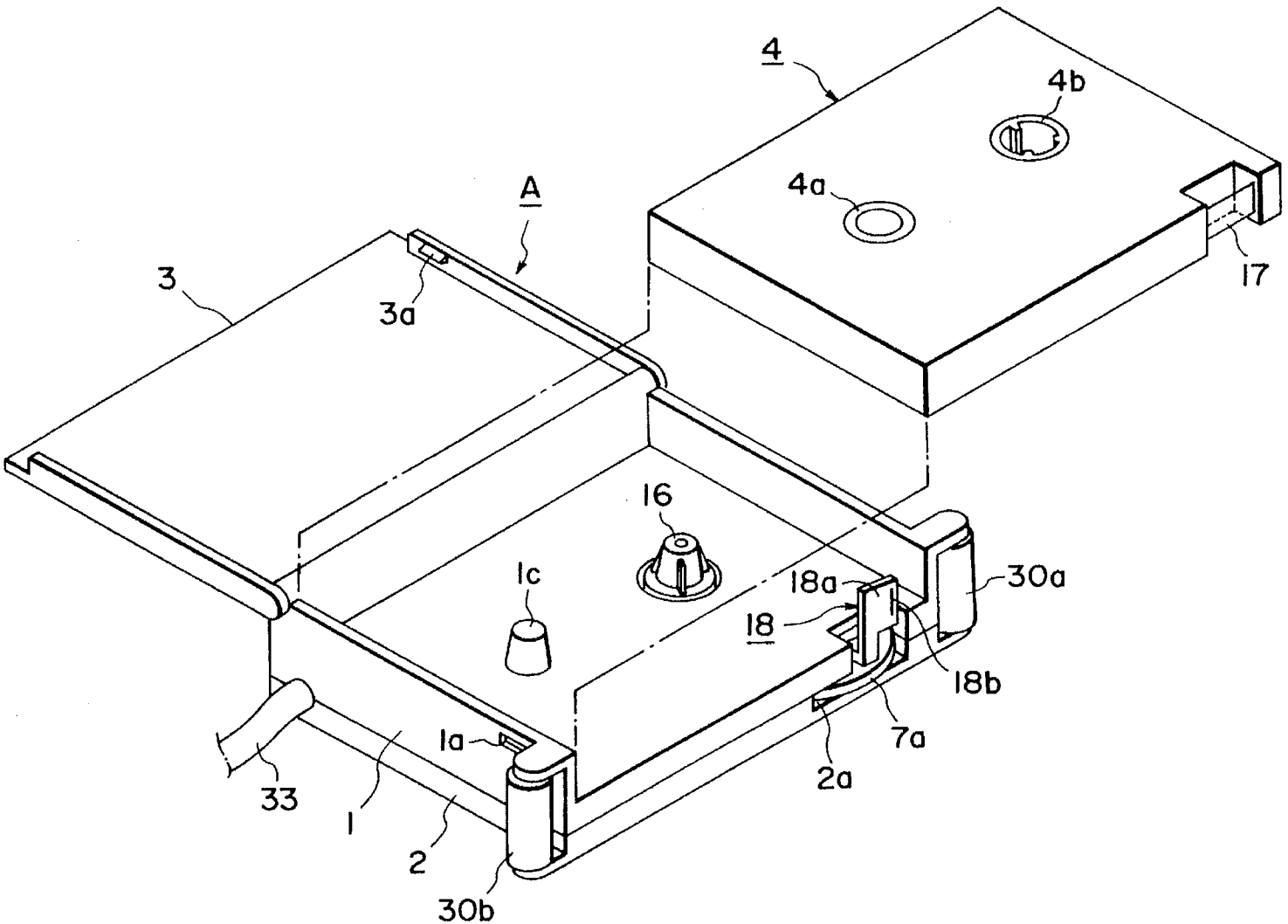
FIG. 1 is a perspective illustration of a recording apparatus according to an embodiment of the present invention.
Figure 2:
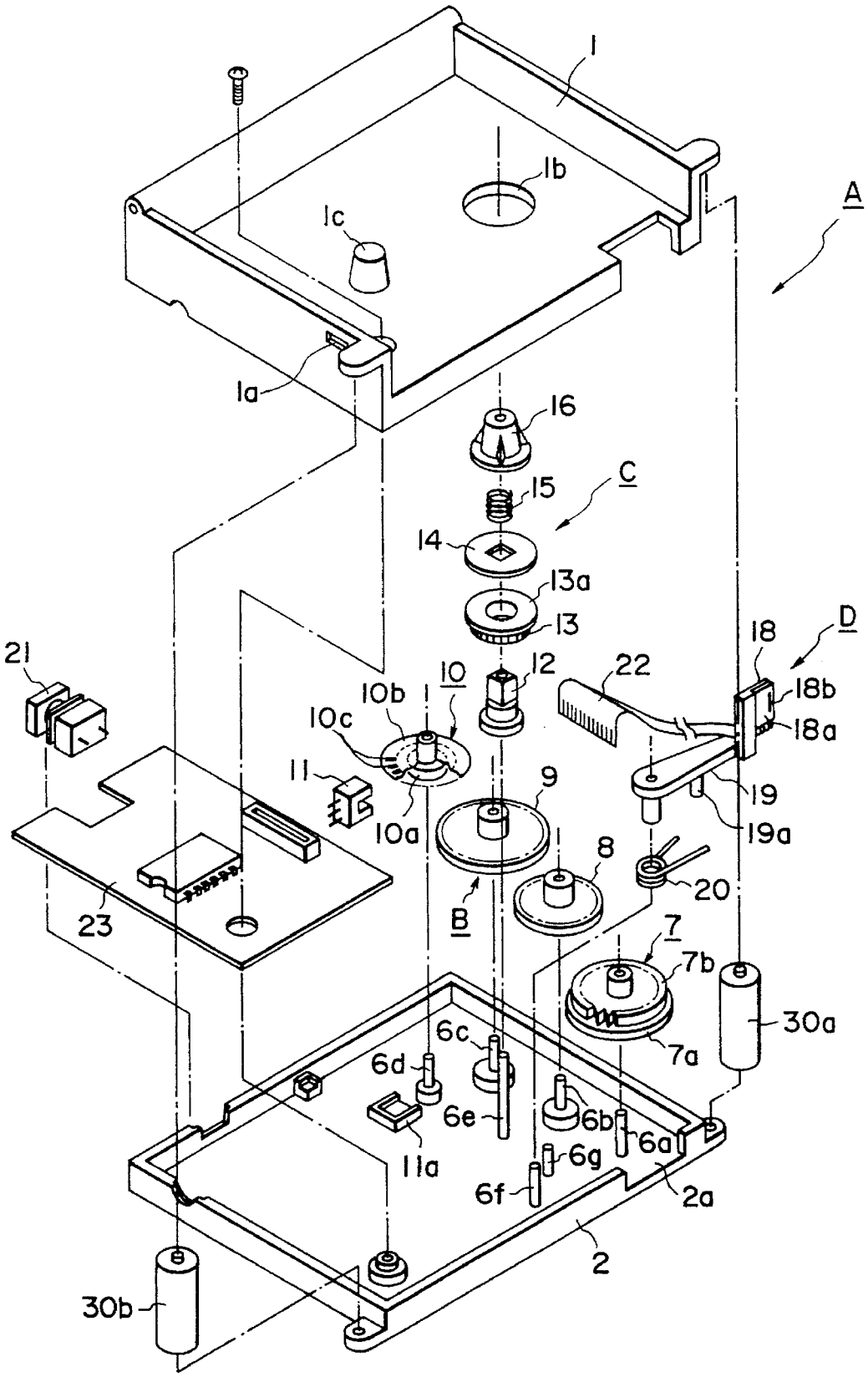
FIG. 2 is an exploded view of the recording apparatus.
Figure 3:
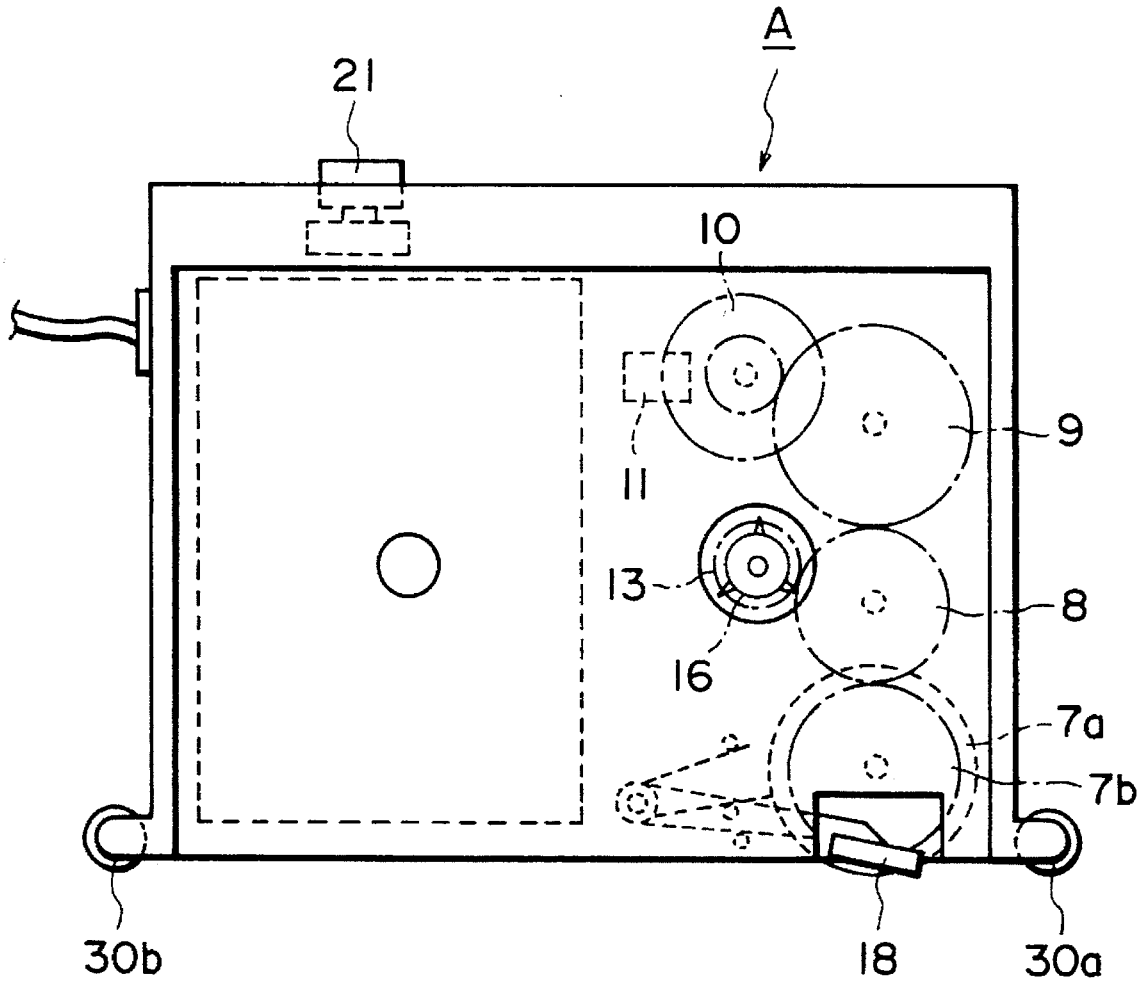
FIG. 3 illustrates the recording apparatus as assembled.
Figure 4:
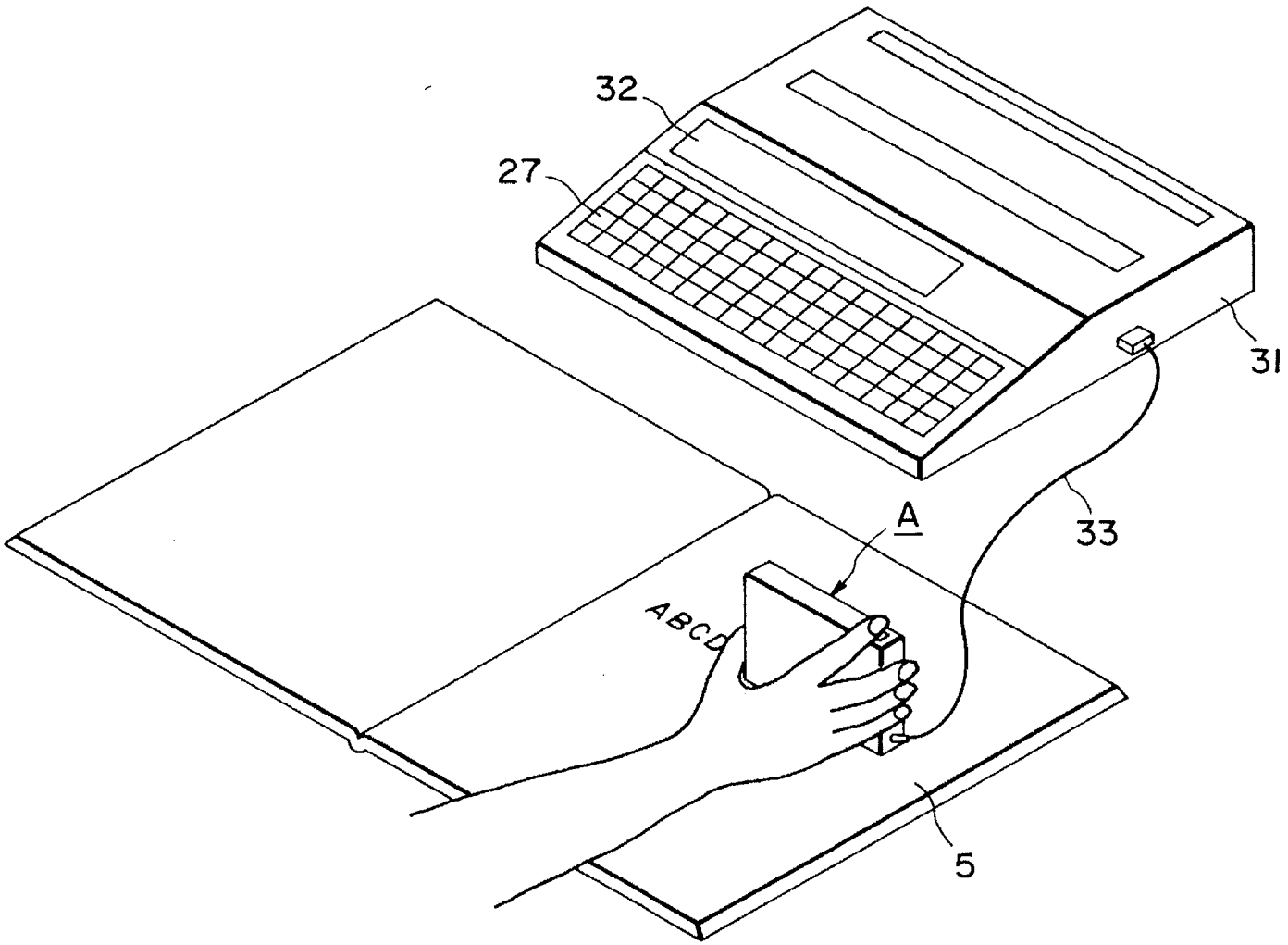
FIG. 4 illustrates the state in which the recording apparatus is used.

FIG. 1 is a perspective illustration of a recording apparatus, FIG. 2 is an exploded perspective view of the apparatus, and FIG. 3 is an illustration of the apparatus as assembled. In these figures, the letter A designates the apparatus body comprising an upper case 1 and a lower case 2 which can be integrally secured to each other as by screws. A lid member 3 is pivotably hinged to the upper case 1. Restraining pawls 3*a* are provided at the opposite side edges of the lid member 3 and are adapted to be engaged with restraining recesses 1*a* provided at the opposite side edges of the upper case 1. An ink ribbon cassette 4 can be contained in the upper case 1. A detecting mechanism B for detecting the amount and speed of movement of the apparatus body A to be described, a conveying mechanism C for a transfer medium and a recording head mechanism D are contained between the upper and lower cases 1 and 2. The apparatus body A may be pushed against a recording medium (such as paper or a plastic sheet and hereinafter referred to as "recording paper") 5, as shown in FIG. 4, and manually or otherwise moved, whereby predetermined image recording can be accomplished.

The constructions of the mechanisms B, C and D will now be specifically described with reference to FIG. 2.

The detecting mechanism B will first be described. A rotational member 7 is rotatably mounted on the shaft 6*a* of the lower case 2, and is adapted to rotate with movement of the apparatus body A. That is, the rotational member 7 has integrally formed therewith a roller portion 7*a* and a gear portion 7*b* smaller in diameter than the roller portion 7*a*, and is mounted so that the roller portion 7*a* protrudes outwardly from the cut-away portion 2*a* of the lower case 2. Accordingly, when the apparatus body A is moved with the roller portion 7*a* bearing against the recording paper 5, the rotational member 7 rotates in conformity with said amount of movement and said speed of movement. This rotation may be transmitted to the gear portion 10*a* of an encode plate 10 through an intermediate gear 8 meshing with the gear portion 7*b* and an intermediate gear 9 meshing with the gear 8. The gears 8 and 9 and the encode plate 10 are rotatably mounted on the shafts 6*b*, 6*c* and 6*d*, respectively, of the lower case 2.

The encode plate 10 has integrally formed therewith the gear portion 10*a* and a thin disc 10*b* of stainless steel or like material, and a plurality of rectangular slits 10*c* are radially formed in the marginal portion of the disc 10*b*. A photosensor 11 is provided at the position of the slits 10*c*. This photosensor 11 has a light-emitting portion and a light-receiving portion, and is mounted on the sensor mounting portion 11*a* of the lower case 2 so that the light from the light-emitting portion passes through the slits 10*c*. to the light-receiving portion. Accordingly, when the rotational member 7 rotates, the encode plate 10 rotates correspondingly thereto and the photosensor 11 which has detected the slits 10*c* produces a pulse signal. The amount and speed of rotation of the rotational member 7 may be detected by this signal.

Guide rollers 30*a* and 30*b* for guiding the movement of the apparatus body A are rotatably mounted at the opposite side edges of the apparatus body A.

The conveying mechanism C for the transfer medium will now be described. A rectangular rotor 12 is rotatably mounted on the shaft 6*e* of the lower case 2. The rotor 12 is pressed into a roll-up shaft 16 with a gear 13 meshing with said intermediate gear 8, a disc 14 and a compression coil spring 15 being successively interposed therebetween.

The gear 13 is mounted for rotation relative to the rotor 12, and the disc 14 is loosely fitted against rotation relative to the rotor 12. A friction plate 13*a* formed of felt or the like is adhesively or otherwise secured to the upper surface of the gear 13, and the disc 14 is urged against the friction plate 13*a* by the biasing force of the coil spring 15.

The roll-up shaft 16 is designed so as to be exposed through an opening 1*b* formed in the upper case 1, and a support shaft 1*c* is projectedly provided on the lo upper case 1. When the ink ribbon cassette 4 is loaded into the upper case 1, the pay-away reel 4*a* of the cassette 4 is rotatably supported on the support shaft 1*c*. The roll-up reel 4*b* of the cassette 4 is designed so as to be fitted against rotation relative to the roll-up shaft 16.

An ink ribbon 17 which is the transfer medium is wound on the pay-away reel 4*a* and the roll-up reel 4*b*, and as the roll-up reel 4*b* is rotated, the ink ribbon 17 is sequentially paid away from the pay-away reel 4*a* to the roll-up reel 4*b*.

The ink ribbon 17 consists of a base film comprising a polyethylene terephthalate film or the like and ink applied on the base film and melted or reduced in viscosity by being heated, and is pressed from the base film side by a recording head 18 to be described and thereby loaded so that the surface thereof having the ink applied thereto can come into contact with the recording paper 5.

In the above-described construction, rotation of the rotational member 7 causes rotation of the gear 13 through the intermediate gear 8 and the rotational force thereof is transmitted to the disc 14 through the frictional force of the friction plate 13*a*, whereby the roll-up shaft 16 is rotated. Thereby the roll-up reel 4*b* is rotated and the link ribbon 17 is sequentially rolled up on the roll-up reel 4*b*.

During the roll-up of the ink ribbon 17, a predetermined or more rotational force is not transmitted to the roll-up shaft 16 by the action of the aforedescribed clutch.

The recording head mechanism D will now be described. Designated by 18 is a recording head having a head base plate 18*a* and a plurality of heat generating elements 18*b* arranged in a row on the head base plate 18*a* that individually generate heat upon supply of electric power thereto. The recording head 18 is adhesively or otherwise secured to a head supporting member 19. This head supporting member 19 is pivotably mounted on the shaft 6*f* of the lower case 2, and the two arms of a torsion coil spring 20 are restrained by a shaft 19*a* projectedly provided on the arm of the member 19 and the shaft 6*g* of the lower case 2. Accordingly, the recording head 18 is biased by the torsion coil spring 20 so as to receive a clockwise moment as viewed in FIG. 2, whereby the heat generating elements 18*b* are urged against the base film surface of the ink ribbon 17.

The recording head 18, the photosensor 11 and further a record activating switch 21 are electrically connected to a circuit base plate 23 by a flexible substrate 22 or the like. A control circuit to be described is provided on the circuit base plate 23, and the driving of the recording head 18 is controlled by this control circuit.

Figure 5:
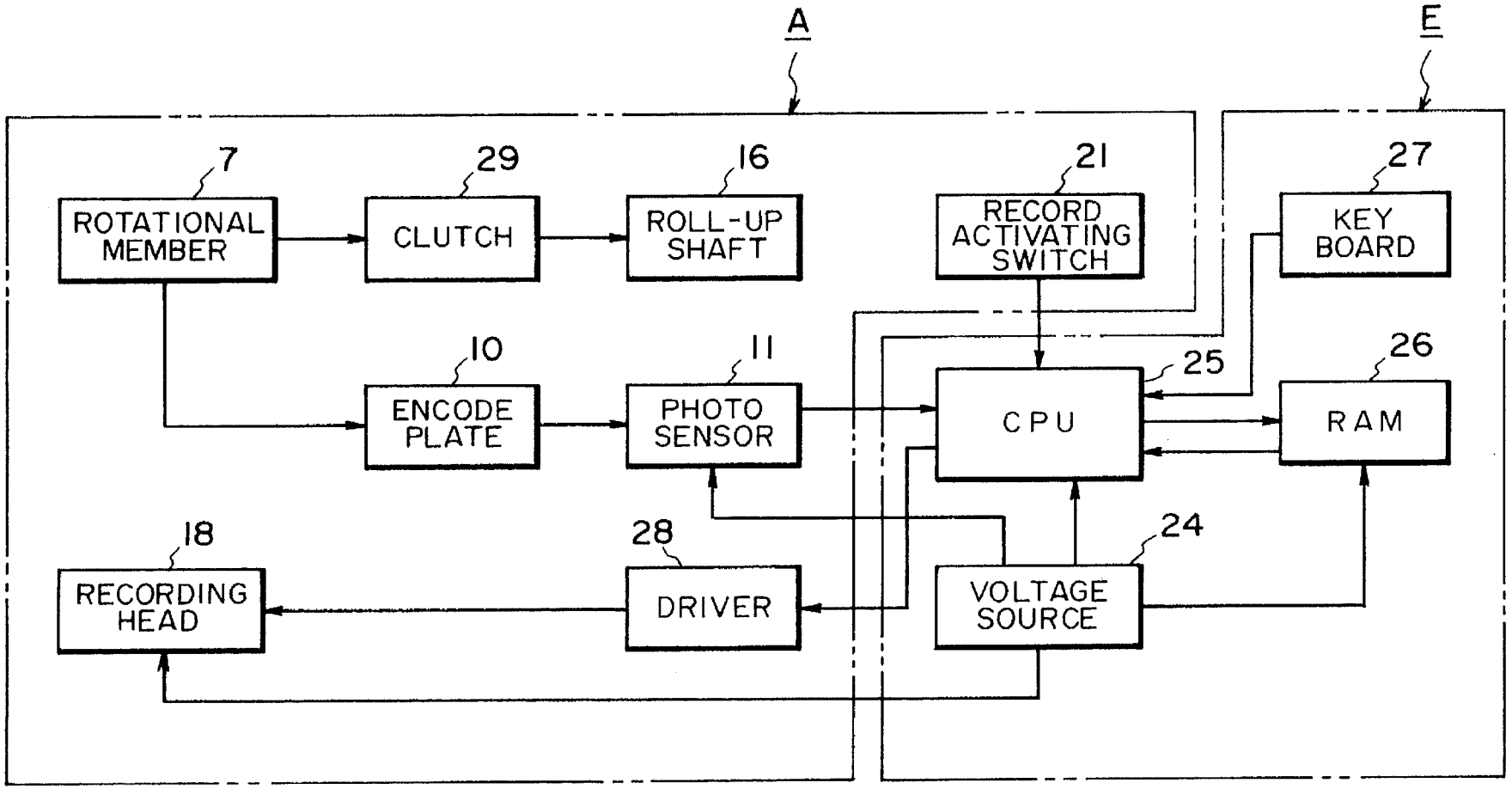
FIG. 5 is a block diagram of a control circuit.

Said control circuit is constructed as shown in FIG. 5. In FIG. 5, the portion encircled by a dots-and-dash line is the circuit provided on the circuit base plate 23, and the portion E encircled by a dot-and-dash line is a circuit provided in an outer instrument such as a word processor.

Said circuit will now be described. A voltage source 24 is supplied to CPU 25, RAM 26, the photosensor 11 and the recording head 18. Recording information input from a keyboard 27 is stored in RAM 26 through CPU 25. When the record activating switch 21 is depressed to thereby rotate the rotational member 7, a pulse signal enters CPU 25 from the photosensor 11 which has detected the slits 10*c* of the disc lob. The CPU 25 reads out recording information prestored in RAM 26 in response to the signal from the photosensor 11, supplies a signal to a driver 28 for driving the recording head 18 and causes the heat generating elements 18*b* of the recording head 18 to generate heat in the form of a pattern, whereby the ink of the ink ribbon 17 is transferred to and recorded on the recording paper 5.

After the recording, the ink ribbon 17 may be on the roll-up reel 4*b* by the rotational force of the rotational member 7 being transmitted to the roll-up shaft 16 through the friction clutch 29.

Description will now be made of a case where use is made of the recording apparatus coustructed as described above.

As shown in FIG. 4, an outer instrument 31 for inputting the recording information, such as a word processor or an electronic typewriter, and the control circuit of the apparatus body A are electrically connected together by a cord 33.

When, for example, the input information input by the keyboard 27 of the outer instrument 31 and displayed on a display portion 32 is to be recorded, if the apparatus body A is pressed against the booklet-like recording paper 5 such as a notebook so that the inked surface of the ink ribbon 17 may contact the recording paper 5, the recording head 18 presses the ink ribbon 17 against the recording paper 5.

When in this state, the apparatus body A is manually moved while the record activating switch 21 is being despressed, the rotational member 7 which is in contact with the recording paper 5 rotates, and the amount and speed of rotation thereof are detected by the encode plate 10 and the photosensor 11. That is, the amount of movement of the apparatus body A is detected by the pulse number from the start of the movement and the speed of movement of the apparatus body A is detected by the pulse period. The recording information stored in RAM 26 is read out correspondingly to the result of said detection, and the recording head 18 is driven in conformity with said information. Accordingly, even if the speed of movement of the apparatus body A is varied, image recording will effected always correspondingly to said speed.

Also, the roll-up shaft 16 is rotated by the rotation of the rotational member 7 which results from the movement of the apparatus body A, whereby the ink ribbon 17 after the recording is rolled up onto the roll-up reel 4*b*.

As the ink ribbon 17 is rolled up, the diameter of the ink ribbon 17 rolled up on the roll-up reel 4*b* varies. Accordingly, it is necessary to vary the amount of rotation of the roll-up reel 4*b* for the amount of movement of the apparatus body A, but as previously described, a rotation torque corresponding to the amount of rotation of the rotational member 7 is transmitted to the roll-up shaft 16 through the friction clutch 29. Thus, irrespective of any variation in said diameter, the ink ribbon 17 is rolled onto the roll-up reel 4*b* by an amount corresponding to the amount of rotation of the rotational member 7.

Since recording can be accomplished by moving the apparatus body A in the manner described above, the recording medium is not restricted to a sheet-like one. Recording can also be easily effected on thick recording mediums and booklet-like recording mediums. Also, the driving of the recording head 18 and the rotation of the roll-up shaft 16 take place in synchronism with the rotation of the rotational member 7 and therefore, it never happens that the ink ribbon 17 is not conveyed while only the recording head 18 is driven, and it never happens that the recording head 18 is not driven while only the ink ribbon 17 is conveyed.

In the aforedescribed embodiment, there has been shown an example in which the detection of the amount of movement of the apparatus body A and the conveyance of the ink ribbon 17 are accomplished by the rotation of the rotational member 7, but alternatively, design may be made such that said detection and said conveyance are accomplished by respective independent constructions.

The rotational member 7 need not be restricted to a roller-like one, but for example, an endless belt or the like may be moved around.

Further, in the aforedescribed embodiment, the rotation of the rotational member 7 is detected by a combination of the encode plate 10 and the photosensor 11, whereas the present invention need not be restricted thereto. Alternatively instead of the encode plate 10, a magnetic pole plate having north and south poles alternately arranged thereon may be mounted so as to rotate correspondingly to the rotational member 7 and design may be made such that the amount of rotation of the rotational member 7 is detected by detecting the rotation of the magnetic pole plate.

Also, in the aforedescribed embodiment, there has been shown an example of the heat transfer type in which the ink ribbon 17 having applied thereto ink melted or reduced in viscosity by heat is used as the transfer medium and recording is effected by the thermal recording head 18. However, a recording system of the wire dot type is likewise applicable.

Also, in the aforedescribed embodiment, there has been shown an example in which the outer instrument 31 is discretely provided so that the recording information from the outer instrument 31 may be recorded. As an alternative example, the outer instrument 31 may be made integral with the apparatus body A and all the control mechanisms shown in FIG. 5 may be contained in the apparatus body A so that the recording apparatus can be used as a single unit, or as a further alternative, the aforedescribed recording apparatus may be mounted on the outer instrument 31 such as a word processor and may be used also as a recording instrument for the outer instrument 31.

The present embodiment, as previously described, is designed such that the movement of the apparatus body is detected and recording is effected in conformity with this movement and therefore, it enables recording to be manually accomplished on thick paper or a booklet-like recording medium such as a notebook.

Also, if design is made such that the movement of the apparatus itself is detected by a rotational member and further the transfer medium is conveyed by said rotational member, the movement of the apparatus itself, the driving of the recording head and the conveyance of the transfer medium can always be synchronized with one another with a result that unsatisfactory transfer and waste of the transfer medium can be eliminated.

Description will now be made of a movement guide for a recording apparatus using an embodiment of the present invention. The aforedescribed recording apparatus is applicable to this movement guide by being fitted to a fitting portion to be described, but in the present embodiment, there is shown an example in which another recording apparatus is applied to the movement guide.

The movement guide described below is comprised of a rail member movable at a predetermined pitch relative to the line direction of the recording medium, and a mark member attached to the rail member to thereby form a ruler.

According to the present embodiment, by moving the recording apparatus along the rail member, the recording apparatus can be caused to scan, for example, rectilinearly. Also, where image recording over several lines is to be effected, the rail member may be moved at each predetermined pitch, whereby image recording in which the interline space is maintained constant may be accomplished.

An embodiment to which said means is applied will now be described with reference to the drawings.

Figure 6:
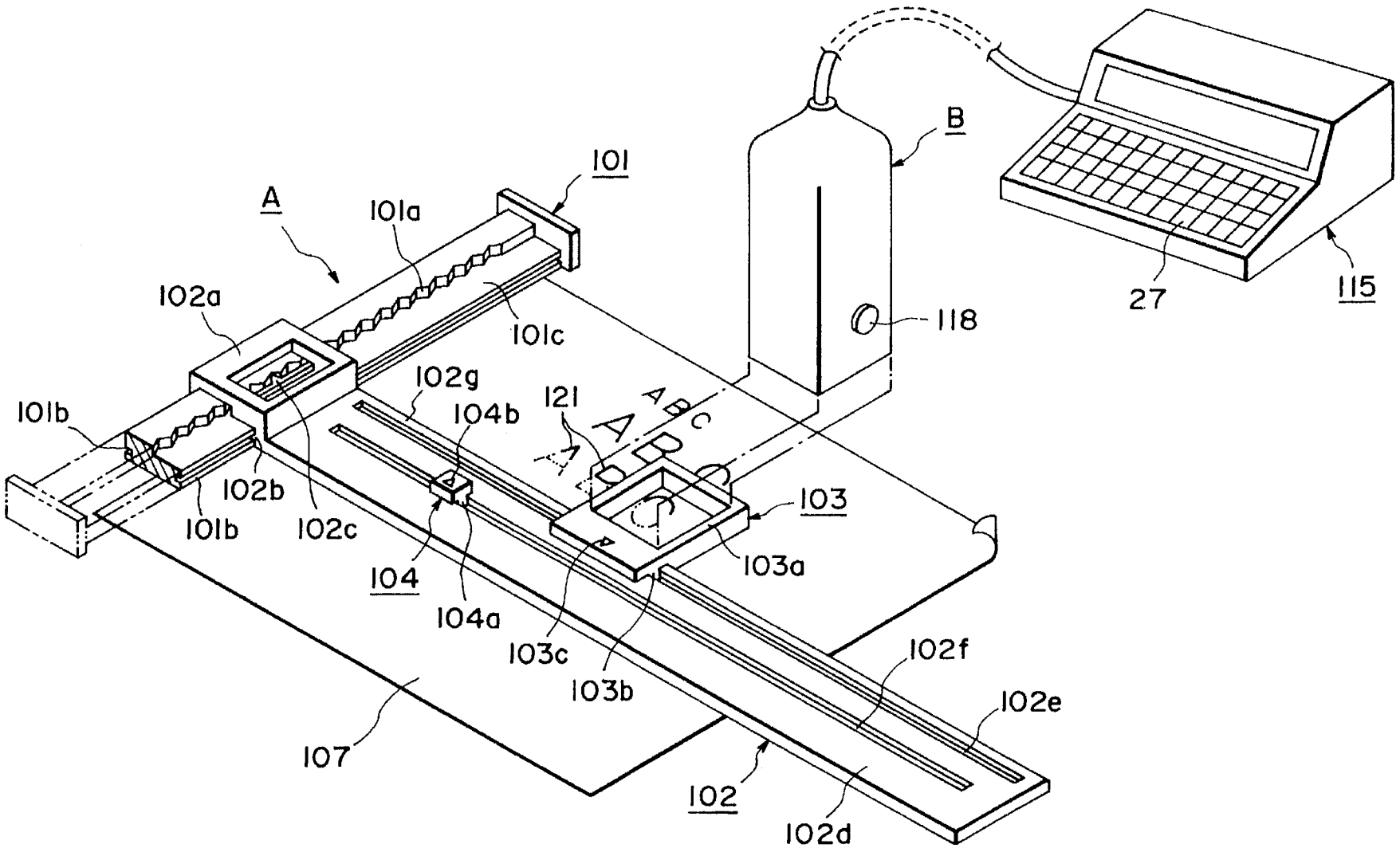
FIG. 6 is a perspective illustration of a ruler according to an embodiment of the present invention.

FIG. 6 is a perspective illustration of a ruler A. In FIG. 6, the reference numeral 101 designates a rack member having teeth 101*a* formed at a predetermined pitch on the upper surface of an elongate member 101*c* and slide grooves 101*b* formed in the opposite side edges of the elongate member 101*c*.

A rail member 102 is attached to the rack member 101. This rail member 102 comprises an elongate member 102*g* orthogonal to the rack member 101. The elongate member 102*g* is mounted so that ridges 102*b* projectedly provided on a base 102*a* of U-shaped cross-section fit in the aforementioned slide grooves 101*b* of the rack member 101 and are slidable along the grooves 101*b*. Further, a pawl 102*c* for meshing with the teeth 101*a* of the rack member 101 is projectedly provided on the base 102*a*. This pawl 102*c* is resilient and may be resiliently deformed to successively mesh with the recesses of the teeth 101*a* when the rail member 102 is slid. Thus, the rail member 102 is slidable at each predetermined interval correspondingly to the pitch of the teeth 101*a* of the rack member 101.

A ruler portion 101*d* is formed integrally with the base 102*a*, and two straight parallel grooves 102*e* and 102*f* are formed in the ruler portion 102*d* in a direction orthogonal to the direction of sliding of the base 102*a*.

A support member 103 to which a recording apparatus B to be described can be removably fitted is mounted on one 102*e* of the two grooves 102*e* and 102*f* of the ruler portion 102*d*.

The support member 103 is formed with a fitting portion 103*a* for the recording apparatus B which comprises an opening (in which the recording apparatus B may be removably fitted), and is mounted so that a ridge 103*b* projectedly provided on the underside of the support member fits in the groove 102*e* of the ruler portion 102*d*. Thus, the support member 103 is slidable along the groove 102*e*.

The reference character 103*c* designates a mark formed at a predetermined location on the support member 103 indicate the recording position.

A mark member 104 is attached to the other groove 102*f* formed in the ruler portion 102*d*. This mark member 104 is slidable along the groove 102*f* with the ridge 104*a* thereof fitted in the groove 102*f* and has a mark 104*b* formed at a predetermined location thereon. A rack and a pawl (not shown) may be provided on the ridge 104*a* and the groove 102*f* so that the mark member 104 can effect click movement of small pitch.

The recording apparatus B fitted to the fitting portion 103*a* of the support member 103 will now be described with reference to the partly broken-away view of FIG. 7.

Figure 7:
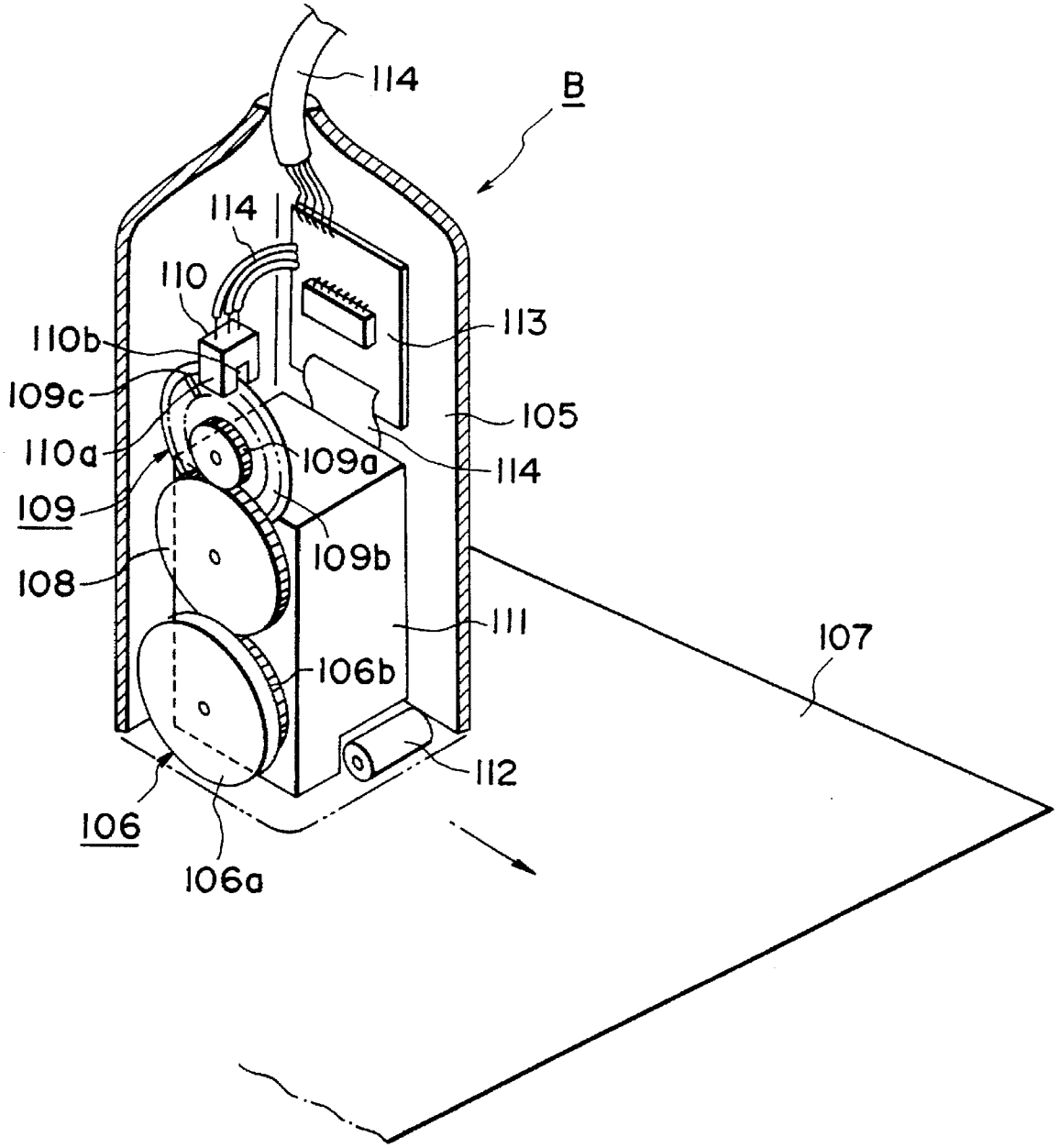
FIG. 7 is a partly broken-away view of the recording apparatus.

In this recording apparatus B, as shown in FIG. 7, a position detecting member 106 is provided so that a portion thereof is exposed from the lower portion of the apparatus body 105. The detecting member 106 has formed integrally therewith a roller portion 106*a* exposed from the apparatus body 105 and adapted to contact a recording medium (such as recording paper or a plastic sheet for OHP and hereinafter referred to as "recording paper") 107 and a gear portion 106*b* of a smaller diameter than the roller portion 106*a*. When the apparatus body 105 is moved with the roller portion 106*a* brought into contact with the recording paper 107, the roller portion 106*a* may rotate correspondingly to said movement.

The gear portion 106*b* of the position detecting member 106 meshes with an intermediate gear 108, which in turn meshes with the gear portion 109*a* of an encode member 109. This encode member 109 has an encode plate 109*b* formed integrally with the gear portion 109*a*. A number of slits 109*c* are radially formed circumferentially of the encode plate 109*b*.

A photosensor 110 is mounted near the encode plate 109*b*. A light emitted from the light-emitting portion 110*a* of the sensor 110 may pass through the slits 109*c* of the encode plate 109*b* to a light-receiving portion 110*b*.

Accordingly, when the apparatus body 105 is moved while being brought into contact with the recording medium 107, rotation of the position detecting member 106 is transmitted to the encoder plate 109*b*, and a pulse signal having a pulse number corresponding to said amount of movement and a pulse period corresponding to the speed of movement is generated from the photosensor 110 which has detected the passage of the light through the slits 109*c*, whereby the amount and speed of movement of the apparatus body 105 are detected.

The reference numeral 111 designates an ink jet type recording head and an ink containing portion. The ink discharge portion thereof (not shown) is provided so as to the opposed to the recording paper 107, and auxiliary rollers 112 are provided on the opposite sides of the apparatus body 105 so as to keep a predetermined spacing with respect to the recording paper 107. It should be noted that the thermal transfer recording may be performed by accommodating for example, a thermal head and ink ribbon in the containing portion 111.

In FIG. 7, the reference numeral 113 denotes a printed circuit substrate carrying electric parts thereon. The substrate 113, the photosensor 110, the recording head 111 and an outer instrument are electrically connected by a cable 114.

The recording head 111 is drivingly controlled correspondingly to the movement of the apparatus body. This control arrangement is constructed as shown in the block diagram of FIG. 8. This will now be described briefly. Recording data from an outer instrument 115 having an input mechanism and a display mechanism, such as a word processor or a reader, is supplied to a data processing unit 116. The data processing unit 116 is adapted to receive a signal from a timing generating unit 119 for receiving a signal from a synchronizing signal generating unit 117 comprising the position detecting member 106, the encode member 109, the photosensor 110, etc. and a signal from a record activating switch 118 and sending the recording timing, and drive the recording head 111 so as to record said recording data in synchronism with the recording timing.

Figure 8:
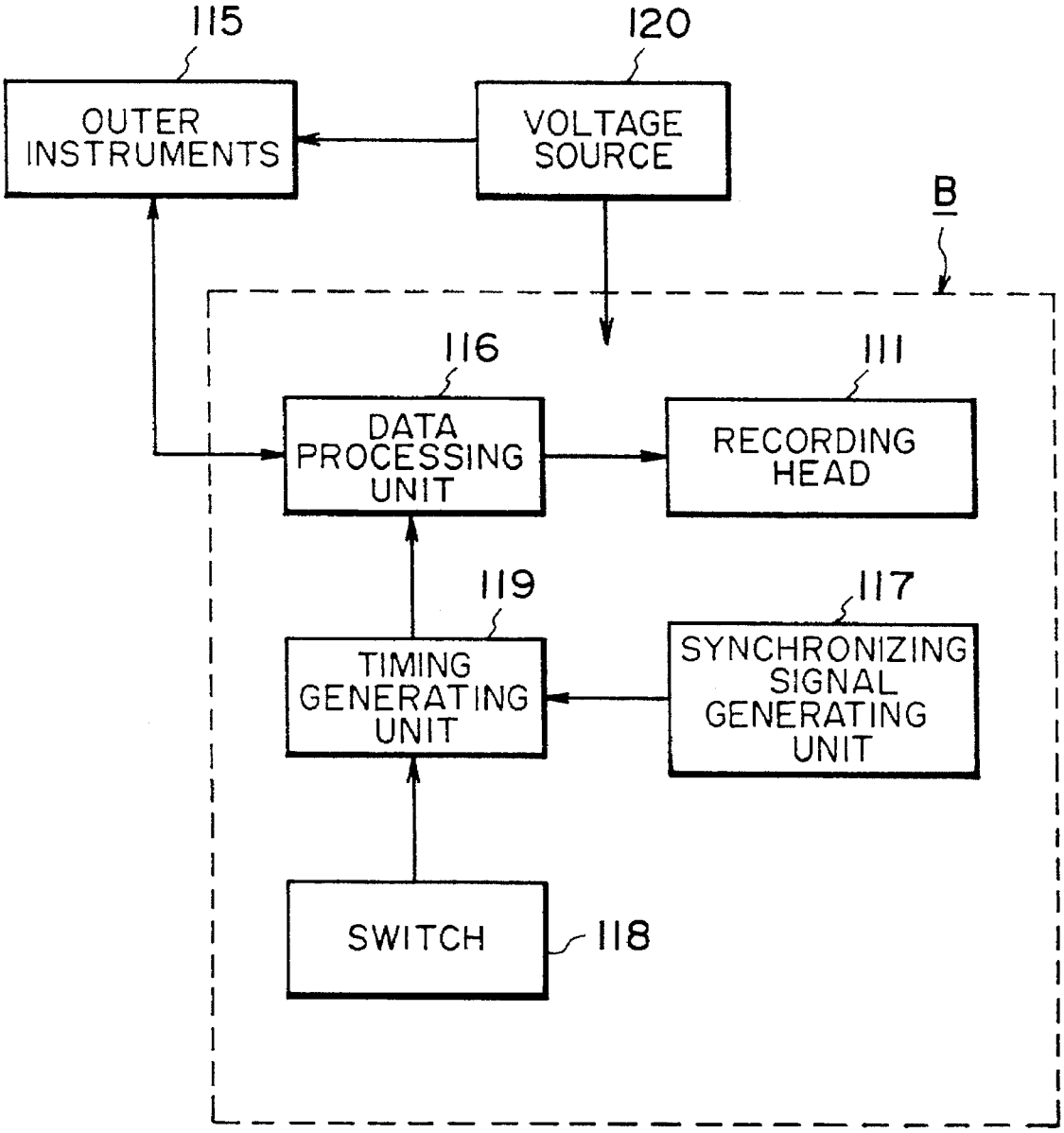
FIG. 8 is a block diagram showing the control construction of the recording apparatus.

The reference numeral 120 designates the voltage source of the outer instrument 115 and the recording apparatus B. The portion encircled by a broken line in FIG. 8 is contained in the recording apparatus B.

Figure 9:
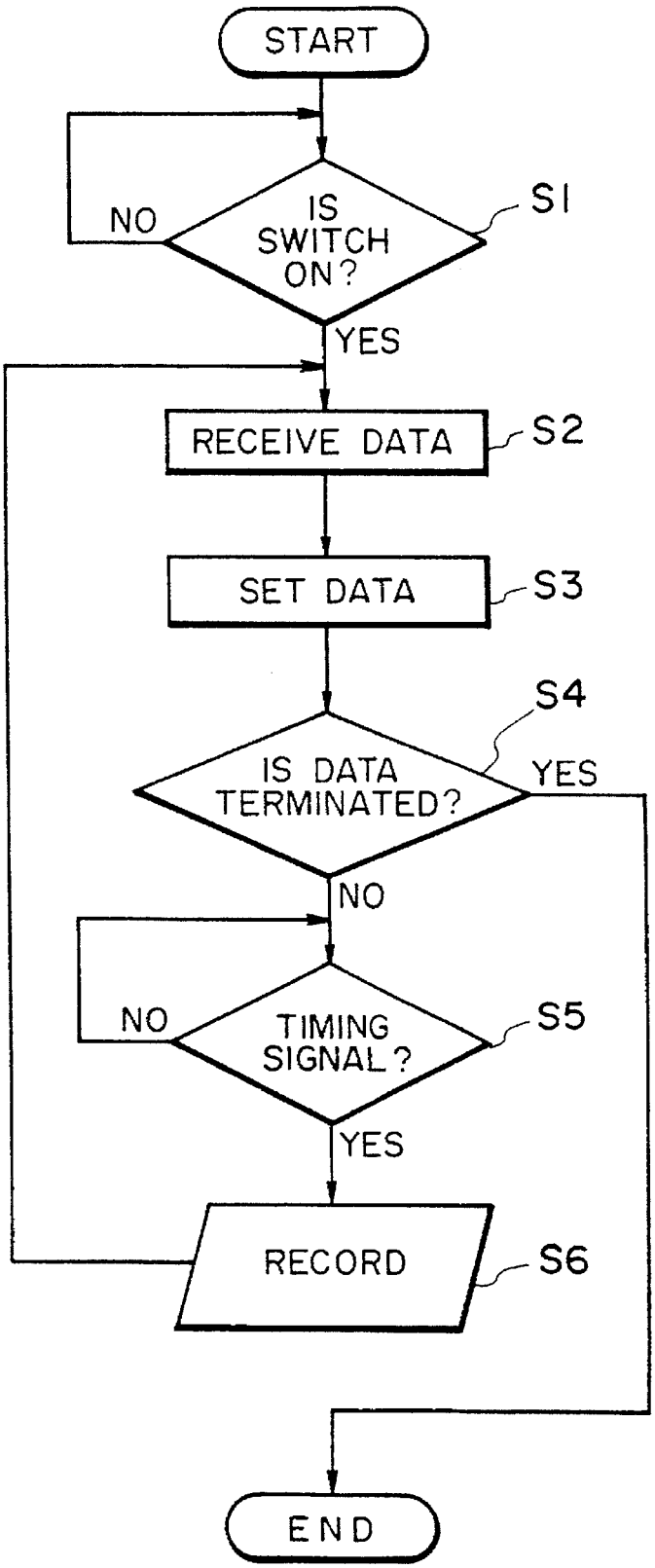
FIG. 9 is a flow chart showing the recording operation.

When recording is to be effected by this recording apparatus B, the recording apparatus is manually moved on the recording paper 107 to thereby effect recording, and the operation thereof is shown in the flow chart of FIG. 9. First, whether the record activating switch 118 is ON is discriminated (step S1), and if the switch 118 is ON, data corresponding to one row (for example, in the case of a head of 24 dots per row, data corresponding to 24 dots) is received from the outer instrument 115 (step S2), and the data is set in the data processing unit 116 (step S3). Subsequently, whether the set data is terminated is discriminated (step S4). If said data is not terminated, whether a recording timing signal has come from the timing generating unit 119 is discriminated (step S5), and if said signal has come, data corresponding to one row is recorded on the recording paper 107 (step S6). By repeating this, predetermined image recording is effected and upon receipt of the termination data, the recording operation is terminated.

Description will now be made of a case where recording is effected with the recording apparatus B loaded on the ruler A.

First, as shown in FIG. 6, the ruler A is placed on the recording paper 107. At this time, it is arranged such that the lengthwise direction of the rack member 101 is the line direction of recording and the lengthwise direction of the rail member 102 is the column direction of recording. The mark member 104 is then slidingly moved in the column direction so that the mark **104*b* registers with the recording start position, and the recording apparatus B is set at the fitting portion 103*a* of the support member 103**.

When recording is to be started, the mark **103*c* of the support member 103 is registered with the position of the mark 104*b* of the mark member 104, and the recording apparatus B is manually moved in the column direction (in the rightward direction as viewed in FIG. 1) while the record activating switch 118 is depressed. Thereby the recording apparatus B performs the previously described operation to effect predetermined recording on the recording paper 107**.

When recording of one line is terminated, the rail member 102 is moved at a predetermined pitch and the recording apparatus B is returned so that the mark **103*c* registers with the mark 104*b* of the mark member 104**, and the recording apparatus B is moved in the column direction in the same manuer as previously described, whereby recording of plural lines is accomplished.

By the recording apparatus B being moved along the groove **102*e*** as described above, recording of one line does not meander, and by the rail member being moved at a predetermined pitch, the inter-line space always becomes constant and the recording start position for each line also becomes constant.

Also, when enlarged characters are to be recorded on two lines as are indicated for example, at 121 in FIG. 6, recording of the upper half may be done by recording of the first one line and recording of the lower half may be done by recording of the next line. In this case, the space between lines can be maintained accurately as previously mentioned and therefore, the characters recorded by upper and lower halves each are accurately combined and an enlarged character is recorded as a whole.

The pitch of the teeth **101*a* of the rack member 101 may be 1/n (n being a natural number) of the length of the dot row in the recording head 111, and the pitch between lines can be varied for each 1/n of the height of the characters. In this case, when an enlarged character is to be recorded, the upper half may first be recorded, and then the rail member 102** may be moved by an amount corresponding to n pitches and the lower half may be recorded.

Figure 10:
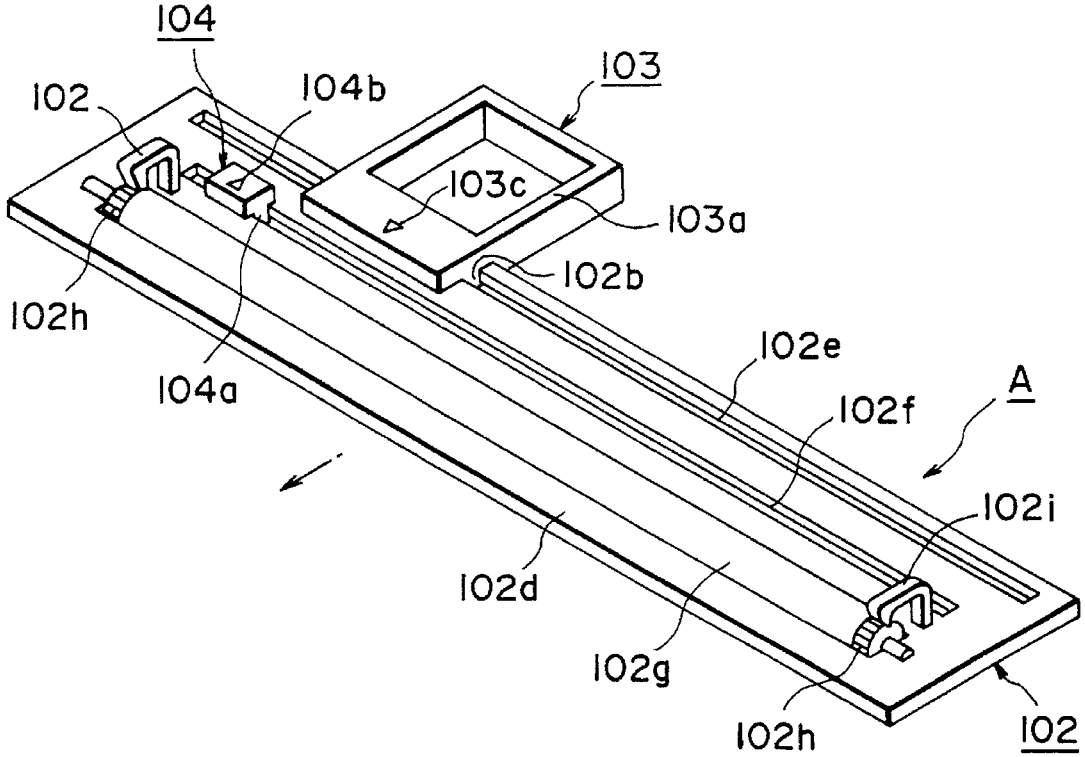
FIGS. 10 and 11 illustrate further embodiments of the ruler.

In the above-described embodiment, the pitch between lines has been prescribed by the tooth pitch of the rack member 101, but alternatively, design may be made as shown in FIG. 10.

The ruler A of FIG. 10 is such that a rectangular window is formed parallel to the lengthwise direction of the rail member 102 and a guide roller **102*g* is rotatably mounted in said window. The roller 102*g* contacts the recording paper 107 and is adapted to rotate when the rail member 102** is moved in the line direction.

Further, at least one recess **102*h* is formed circumferentially at each end of the guide roller 102*g*, and a restraining pawl 102*i* projectedly provided on the upper surface of the rail member 102 may be engaged with the recess 102*h*** to thereby perform the click operation.

Where the circumference of the guide roller **102*g* is set to m times (m being a natural number) the length of the dot row of the recording head 111 and m×n recesses 102*h* are provided at equal intervals in the circumferential direction, the rail member 102** is moved by an amount corresponding to one dot row by moving the click n times.

Figure 11:
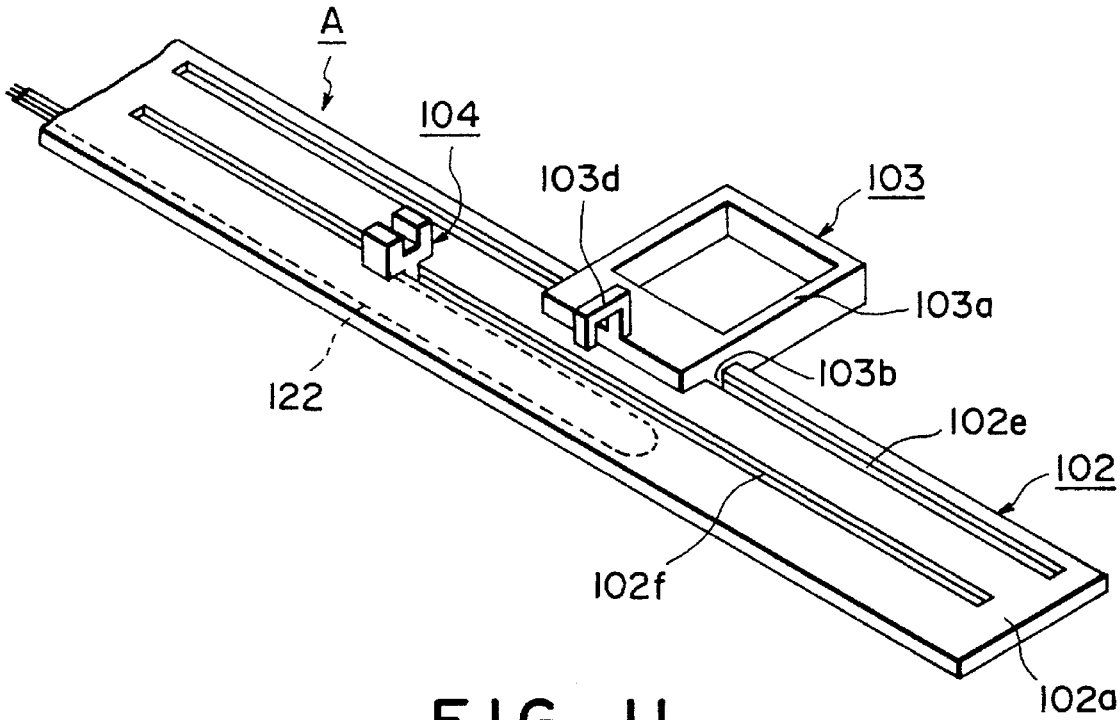

Also, in the embodiment shown in FIG. 6, the line heads have been registered with one another by registering the mark **103*c* of the support member 103 with the mark 104*b* of the mark member 104, but alternatively, design may be made as shown in FIG. 11**.

The construction of FIG. 11 is such that the mark member 104 is constituted by a photosensor having a light-emitting portion on one inner surface of a groove and having a light-receiving portion on the other inner surface and a shield portion **103*d* passing through the groove of said photosensor is mounted on the support member 103. In FIG. 11, the reference numeral 122 designates a cord or the like for transmitting the output from the mark member 104** to the control system.

Figure 12:
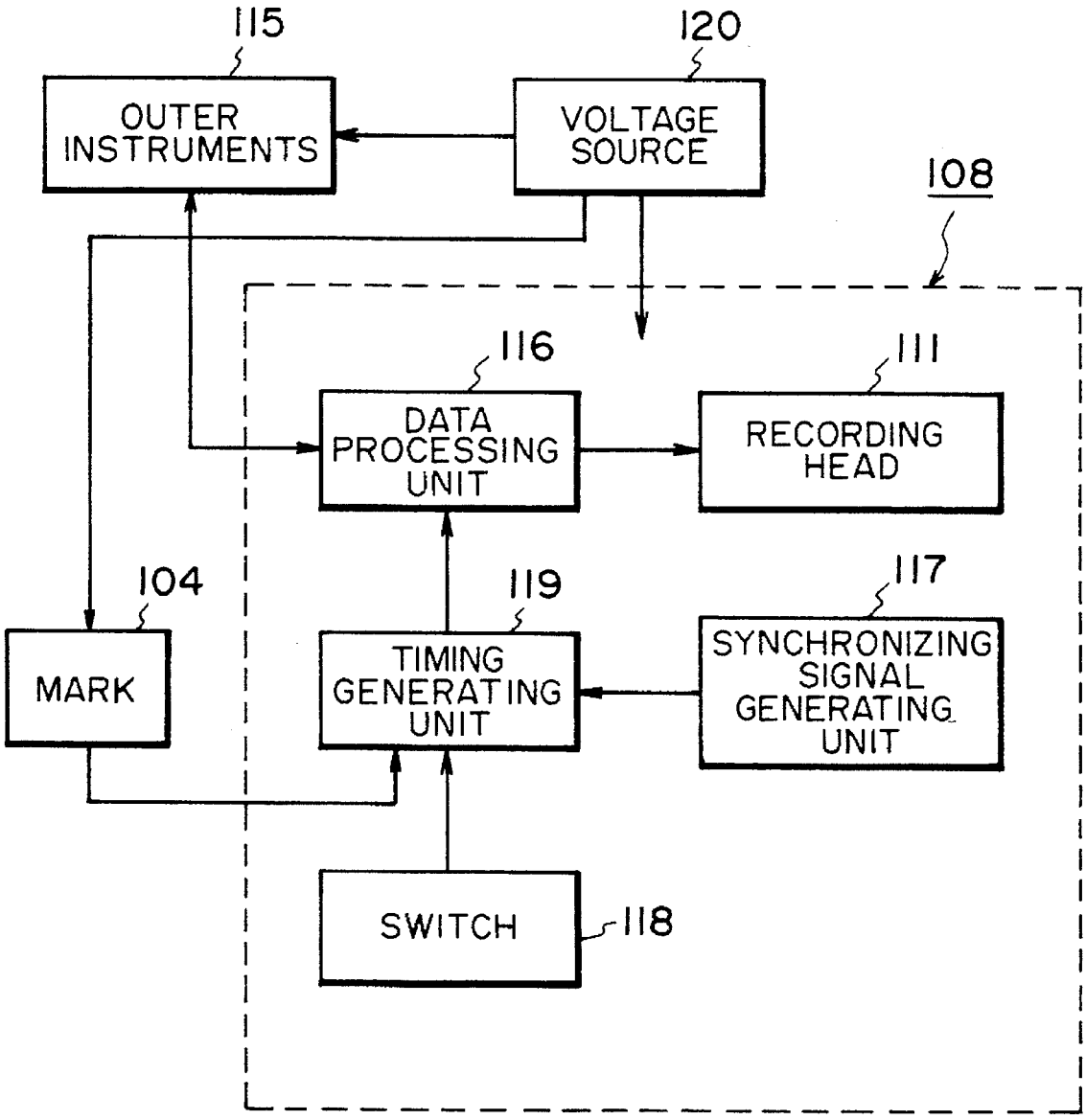
FIGS. 12 and 13 are a block diagram and a flow chart, respectively, showing the control construction of the embodiment of FIG. 11.

The drive control in this embodiment is such that as shown in the block diagram of FIG. 12, the signal from the mark member 104 is transmitted to the timing generating unit 119 in the recording apparatus B, and is similar in the other points to the construction of FIG. 8.

Figure 13:
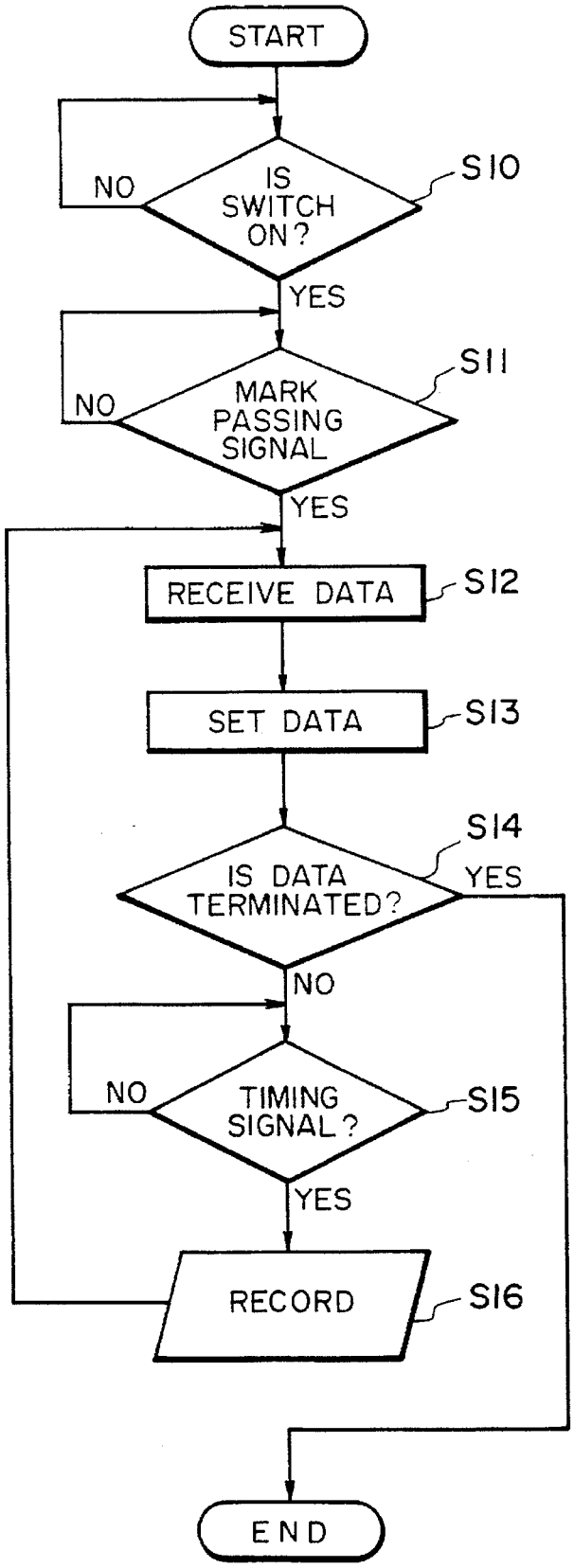

As regards the recording operation of the above-described construction, as shown in the flow chart of FIG. 13, the recording apparatus B set on the support member 103 is positioned at the left of the mark member 104 and the record activating switch 118 is depressed (step S10), whereafter the recording apparatus B is moved in the column direction. When the shield portion **103*d* passes through the groove of the mark member 104**, the photosensor detects it (step S11) and recording is started by this detection. The operation after recording has been started is similar to the steps S2 and so on of FIG. 9 (steps S12–S16).

The construction as described above could eliminate the cumbersomeness in the alignment of the support member 103 and the mark member 104.

In the embodiment of FIG. 11, the mark member 104 is constituted by a photosensor, but alternatively, the mark member may be a microswitch or the like which is capable of detecting the passage of the support member 103.

Figure 14:
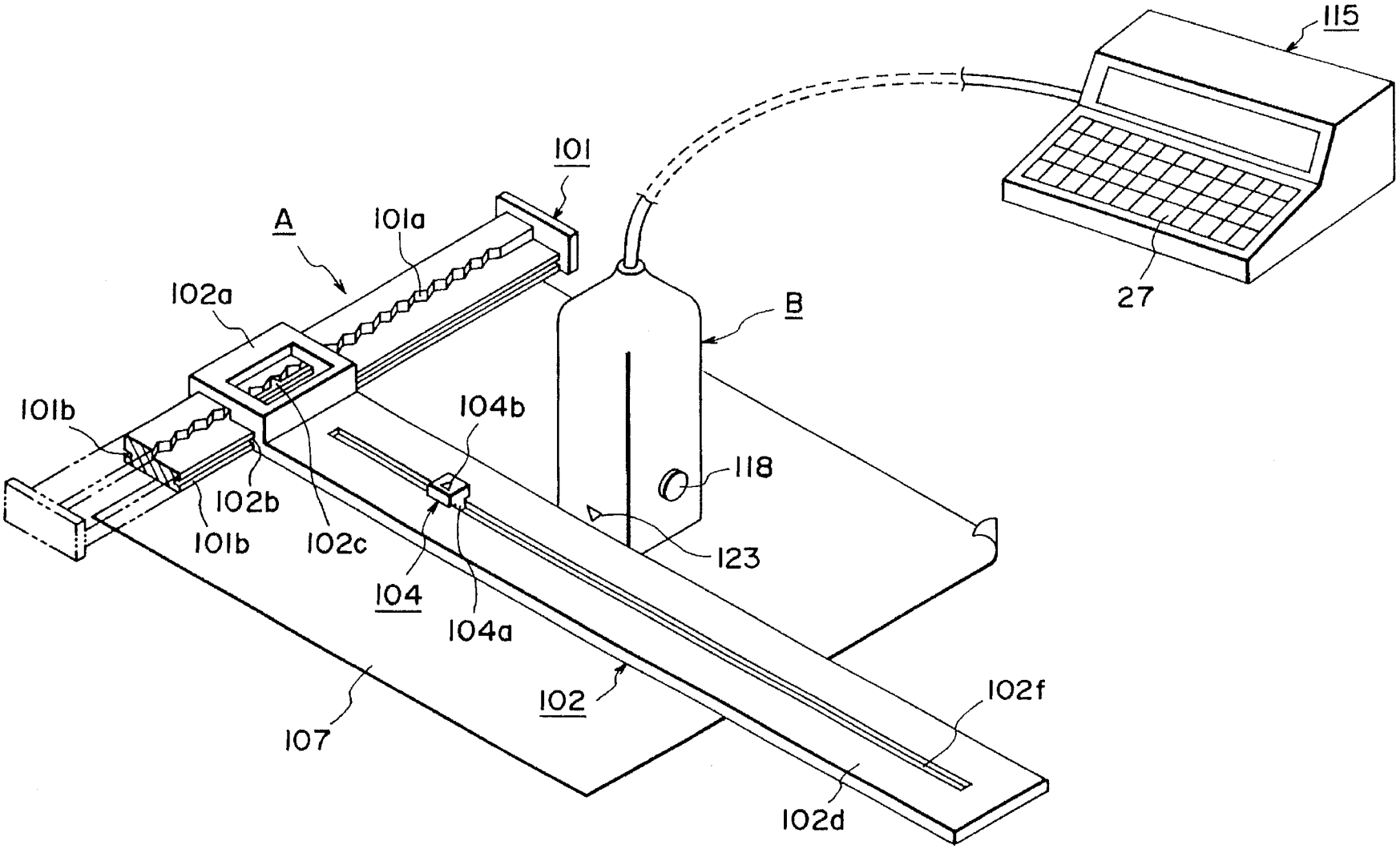
FIG. 14 illustrates an embodiment in which a support member is not provided.

Also, in the embodiment of FIG. 6, design has been made such that the recording apparatus B is set on the support member 103 and is moved with the support member 103. Alternatively, design may be made such that as shown in FIG. 14, one side of the recording apparatus bears against the lengthwise end surface of the ruler unit 102*d* and the recording apparatus is moved along this end surface. In such a case, if a mark 123 is provided on a side of the recording apparatus B, there can be obtained an effect similar to that of the FIG. 6 embodiment even if the support member 103 is not provided.

In the present embodiment, as previously described, the movement of the recording apparatus which scans can be manually or otherwise guided and therefore, the movement of the recording apparatus does not meander and recording of good rectilinearity can be accomplished. Also, even enlarged characters or the like can be accurately recorded.

Another embodiment to which the present invention is applied will now be described with reference to FIGS. 15 to 19.

The embodiment which will now be described is such that a bed frame (a base bed) is formed with a window (an opening) and a transfer recording medium is mounted so as to close said window, namely, over the full width of the window and an encoder scale is provided on the surface of said bed frame. The reference numeral 201 designates a transfer recording medium mount (hereinafter referrred to as the mount) to which an embodiment of the present invention is applied. The reference numeral 202 denotes a bed frame formed by thick paper or a plastic plate or a metal plate and having a window 203 formed in the central portion thereof.

The inner wall 203*a* of the window 203 has the function as a guide A. Accordingly, by moving the body 206 of a recording apparatus to be described along the inner wall 203*a*, the body 206 can be moved accurately in a desired direction. At this time, the body 206 of the recording apparatus can be caused to suitably bear against the inner wall 203*a*.

Also, an ink sheet 204 as a transfer recording medium is mounted in such a manner as to close the entire window 203. The closure of the window 203 by the ink sheet 204 may be accomplished by mounting the ink sheet, for example, on one surface of the bed frame 202 so as to cover the entire window 203, or by constructing the bed frame 202 of two sheets and attaching these two sheets to the ink sheet 204 with the latter interposed therebetween.

The ink sheet 204 is a transfer recording medium consisting of a film-like back-up member and ink layered thereon, said transfer recording medium being cut to dimensions necessary to cover the window 203 and mounted on the bed frame 202.

An encoder scale 205 is provided on the frame 202 and around the window 203 by means such as printing or the like.

Figure 16A:
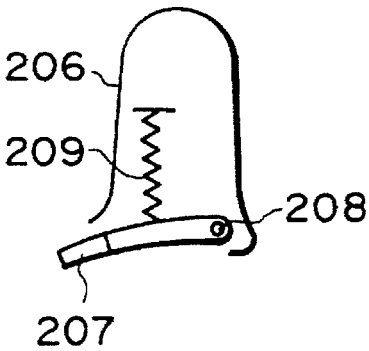
FIGS. 16A–16C are schematic illustrations of the recording apparatus body.
Figure 16B:
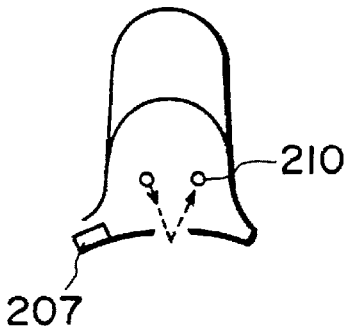
Figure 16C:
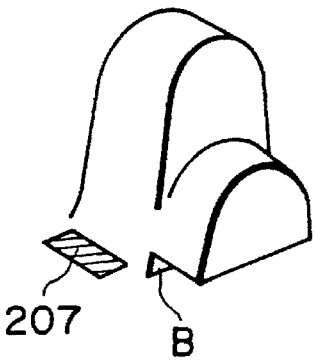

FIGS. 16A–16C show a manually scanned recording apparatus using the mount 201 to effect recording.

In FIG. 16A, the reference numeral 206 designates the body of the recording apparatus. The reference numeral 207 denotes a recording head having a plurality of heat generating elements provided on the surface threreof, the heat generating elements being effective to receive recording information from a controller, not shown, and selectively generate heat. The recording head 207 is pivotally supported on a fulcrum 208 and biased by a push spring 209 so as to be urged against the recording medium.

Designated by 210 in FIG. 16B is a photointerrupter contained in the recording apparatus body 206. The photointerrupter 210 reads the encoder scale 205 provided on the bed frame 202, produces a pulse signal and transmits this pulse signal to a control unit.

A portion of the outer wall of the recording apparatus body 206 has the function as a guide B as shown in FIG. 16C, and is designed to contact the guide A which is the inner wall of the aforementioned window 203.

Figure 15:
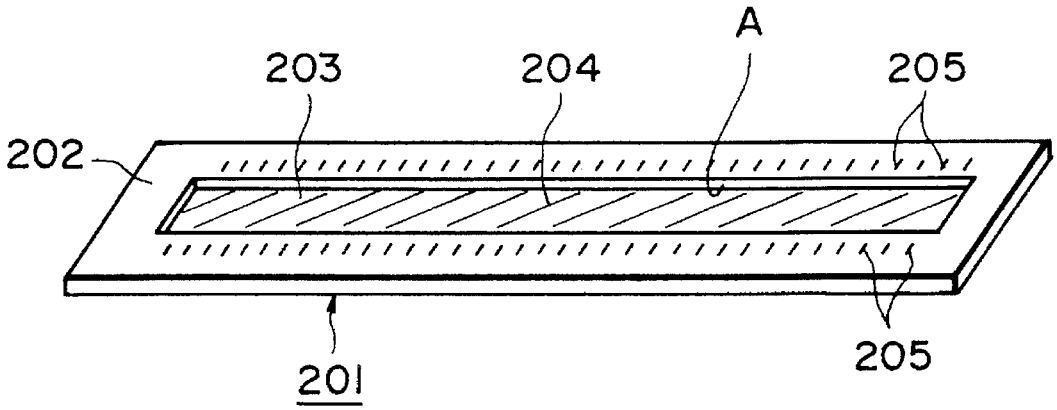
FIG. 15 illustrates a transfer recording medium mount to which an embodiment of the present invention is applied.
Figure 17:
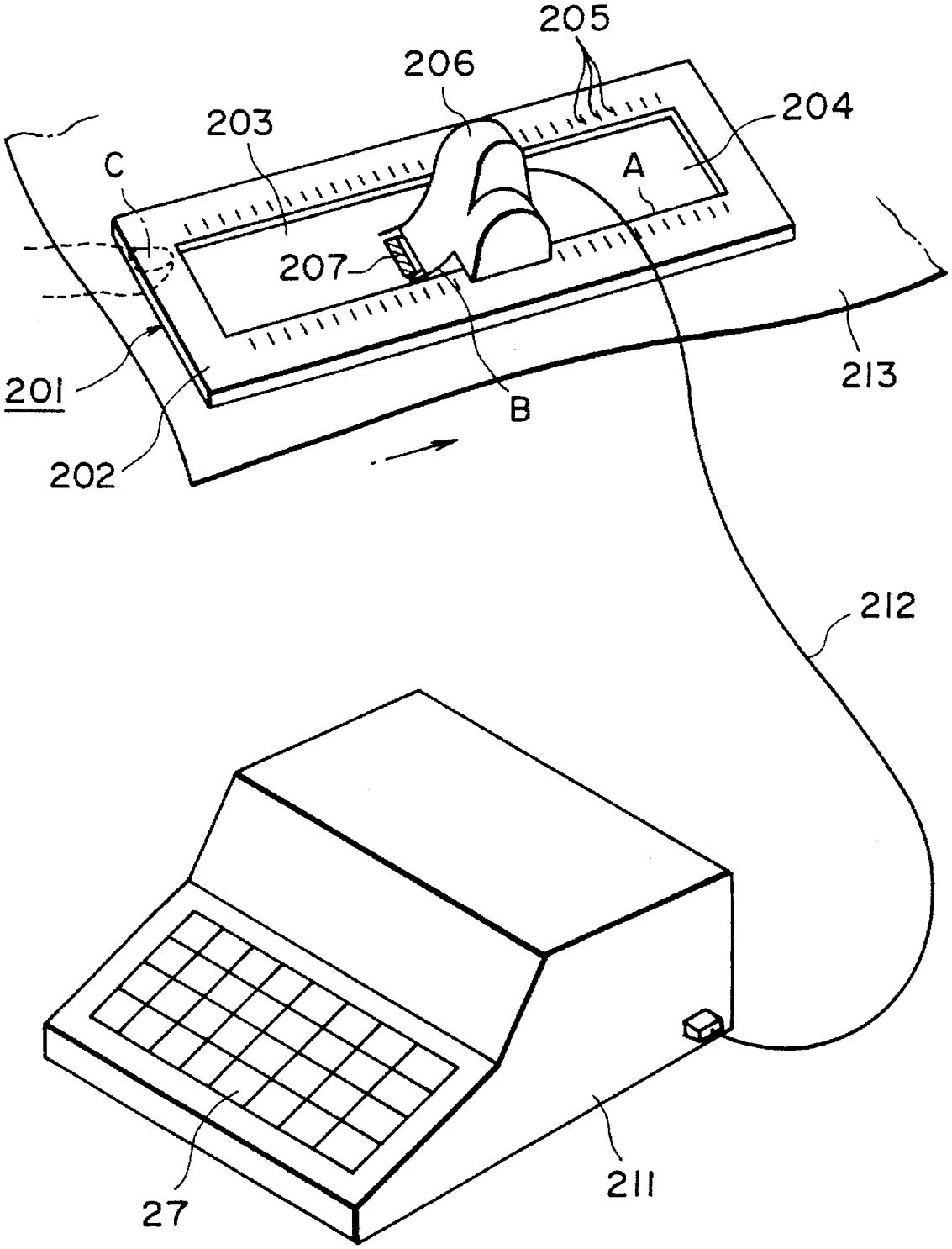
FIG. 17 illustrates a case where recording is carried out.

FIG. 17 is an illustration of a case where recording is executed by the use of the mount 201 according to the present embodiment shown in FIG. 15 and the recording apparatus shown in FIGS. 16A–16C.

In FIG. 17, the reference numeral 211 designates a control unit such as a word processor or an electronic typewriter. The control unit 211 is connected to the recording apparatus body 206 by a cord 212 to mutually exchange the output signal of the control unit 211 and the output signal of the photointerrupter 210.

The reference numeral 213 denotes a recording sheet as a recording medium. It may be, for example, recording paper or a plastic sheet for OHP or a notebook.

Description will now be made of a case where recording is executed by the use of the manually scanned recording apparatus constructed as shown in FIG. 17.

The mount 201 is placed at a position on the recording sheet 213 on which recording is to be effected, a portion of the mount 201, for example, a portion C, is held down by a hand to fix the mount 201, the recording apparatus body 206 is inserted into the window 203, and the guide B which is a portion of the outer wall of the recording apparatus body 206 is caused to bear against the guide A which is the inner wall of the window 203, whereupon recording is started.

The recording information is supplied from the control unit 211 such as a word processor to the recording apparatus body 206 via the cord 212.

The recording head 207 is biased by the spring 209 and urged against the recording sheet 213 with the ink sheet 204 interposed therebetween. The heat generating elements on the recording head 207 selectively generate heat by the recording information to melt the ink of the ink sheet 204 or reduce the viscosity of the ink, and transfer the ink onto the recording sheet 213 as the recording apparatus body 206 is moved.

The recording apparatus body 206 is manually scanned to execute recording. Accordingly, the scanning speed of the recording apparatus body 206 does not always assume a predetermined value.

It has already been described that the scanning state, for example, the scanning speed, of the recording apparatus body 206 and the executed state of recording by the recording information from the control unit 211 have a close relation. That is, the output of the recording information from the control unit 211 must correspond to the scanning speed of the recording apparatus body 206.

The photointerrupter 210 reads the encoder scale 205 provided on the bed frame 202, converts the result of the reading into a pulse signal and transmits this pulse signal to the control unit 211. This pulse signal provides the information regarding the scanning speed of the recording apparatus body 206.

The control unit 211 transmits the recording information corresponding to the momentary scanning speed of the recording apparatus body 206 to the recording head 207, whereby recording is executed on the recording sheet 213 by the recording head 207.

Where the conventional roller provided in the recording apparatus is rotated by the friction with the recording sheet and by this rotation, an encoder disc is rotated to thereby detect the scanning speed of the recording apparatus, if the roller slips, no signal is produced in the meantime and accordingly, the resultant recording is incomplete.

In the present embodiment, the encoder scale 205 is provided on the bed frame 202 and therefore, even if the recording apparatus body 206 slips, the photointerrupter 210 reliably reads the encoder scale 205. Accordingly, the exchange of the signal with the control unit 211 is effected normally. Thus, the resultant image is accurate and a clear-unit.

Figure 18:
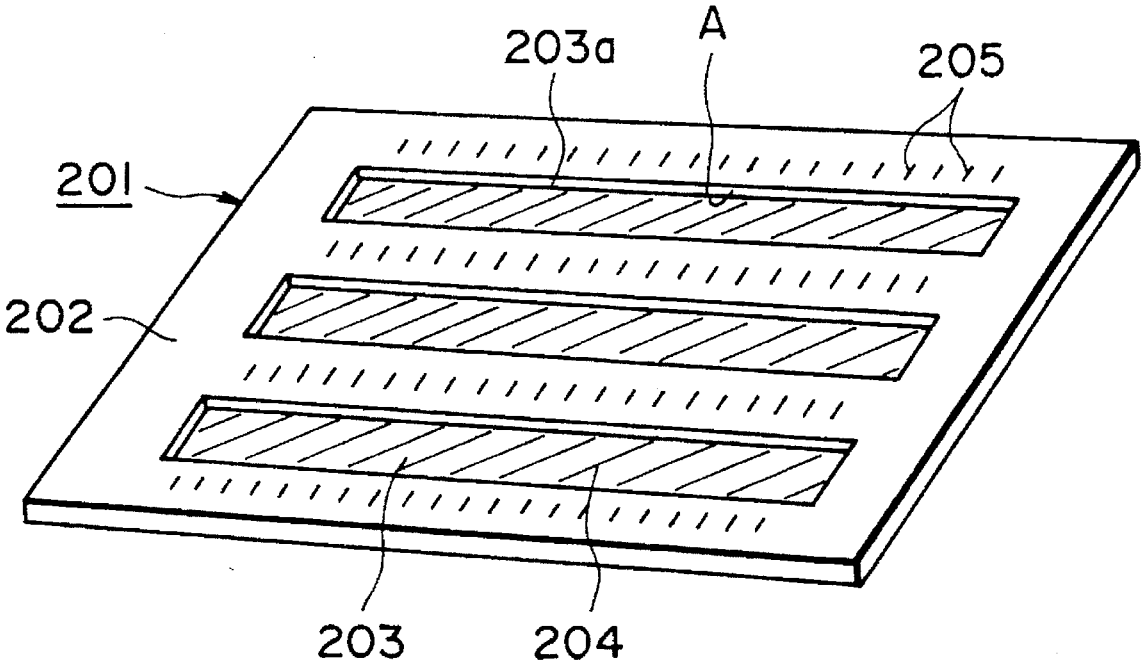
FIGS. 18 and 19 show further embodiments of the present invention.

FIG. 18 shows another embodiment of the mount 201. In FIG. 18, the mount 201 has a plurality of windows 203 formed in the bed frame 202 and ink sheets 204 are mounted in the respective windows 203. Encoder scales 205 are provided correspondingly to the respective windows 203.

Figure 19:
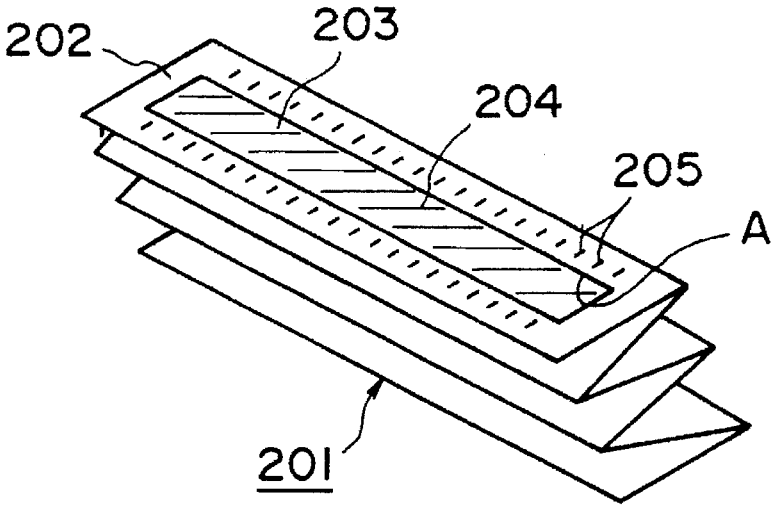

FIG. 19 shows still another embodiment of the mount 201. In FIG. 19, the bed frame 202 is formed with a plurality of windows 203 and is independently foldable at each window 203. Such mount is handy for carrying about, and by forming each line of fold by perforations, such mount can be separated into discrete sheets for individual uses. Further, such mount after being used is also convenient for being discarded.

Also, in the embodiments shown in FIGS. 18 and 19, it is possible to mount ink sheets 204 of plural colors and thus, color recording of plural colors can be easily obtained.

As described above, the mount 201 can be suitably designed and used in accordance with the purpose thereof.

As described hitherto in detail, the present embodiment has a transfer recording medium mount, and the encoder scale provided on the bed frame of this mount is read by the photointerrupter provided on the recording apparatus body side, whereby the scanning state can be reliably detected to thereby execute recording without being affected by the slip of the recording apparatus body. Also, by moving the recording apparatus along the inner wall of the bed frame, image recording can be accurately accomplished at a predetermined position.

Further, the recording apparatus body does not require an ink ribbon and an encoder disc and can therefore be made compact.

As described above, according to the present invention, accurate image recording can be accomplished at a predetermined position.

What is claimed is:

1. A movement guide for guiding the movement of a hand recording means manually movable for recording onto a recording medium, said guide comprising:

a guide member for guiding the hand recording means when the hand recording means is manually moved, said guide member being portable and contactable with the recording medium;

a base member engageable with said guide member, said base member being portable and capable of sliding said guide member in predetermined intervals; and an engaging portion provided on and movable along said guide member for detachably engaging with said hand recording means, wherein said base member comprises a rack member, said rack member having teeth arranged at a constant pitch on an upper surface of an elongated member and being provided with sliding grooves on both sides thereof in a direction along its shortest sides.

2. A movement guide according to claim 1, wherein said hand recording means has an ink ribbon and a thermal head for transferring onto the recording medium ink contained in said ink ribbon.

3. A movement guide according to claim 1, wherein said guide member comprises a rail member having an elongated member perpendicular to said rack member.

4. A movement guide according to claim 1, wherein said guide member comprises a rail member being slidable in constant intervals in accordance with a pitch of said rack member.

5. A movement guide according to claim 1, wherein said hand recording means comprises an ink jet recording head for discharging ink from a discharge port to record on the recording medium.

6. A movement guide according to claim 1, wherein said guide member comprises slidable fitting means for fitting said hand recording means.

7. A movement guide for guiding the movement of hand recording means manually movable for recording onto a recording medium, said guide comprising:

a guide member for guiding said hand recording means when said hand recording means is manually moved, said guide member being portable and contactable with the recording medium; and a base member engageable with said guide member, said base member being portable and capable of sliding said guide member in predetermined intervals, wherein said base member comprises a rack member, said rack member having teeth arranged at a constant pitch on an upper surface of an elongated member and being provided with sliding grooves on both sides thereof in a direction along its shortest sides.

8. A movement guide according to claim 7, wherein said guide member comprises a rail member having an elongated member perpendicular to said rack member.

9. A movement guide according to claim 7, wherein said guide member comprises a rail member being slidable in constant intervals in accordance with a pitch of said rack member.

10. A movement guide according to claim 7, wherein said hand recording means comprises an ink jet recording head for discharging ink from a discharge port to record on the recording medium.

11. A movement guide according to claim 7, wherein said guide member comprises slidable fitting means for fitting said hand recording means.

12. A hand recording device for recording onto a recording medium by manually moving along a movement guide having a guide member capable of being carried and contactable with a predetermined position of said recording medium, an engaging portion movable along the guide member for detachably engaging with said hand recording device, said device comprising:

recording means for recording onto a recording medium; and an engaging portion provided on a body of said device for detachably engaging with the engaging portion of the guide member.

13. In combination, a movement guide and a hand recording device for recording onto a recording medium by manually moving along said movement guide, said movement guide having a guide member for guiding the hand recording device when the hand recording device is manually moved, said guide member being portable and contactable with the recording medium, a base member engageable with said guide member, said base member being portable and capable of sliding said guide member in predetermined intervals, and an engaging portion provided on and movable along said guide member for detachably engaging with said hand recording device, wherein said base member comprises a rack member, said rack member having teeth arranged at a constant pitch on an upper surface of an elongated member and being provided with sliding grooves on both sides thereof in a direction along its shortest sides, said hand recording device comprising:

recording means for recording onto the recording medium; and an engaging portion provided on a body of said device for detachably engaging with the engaging portion of said movement guide.

14. A movement guide for guiding the movement of a hand recording means manually movable for recording onto a recording medium, said guide comprising:

a guide member for guiding the hand recording means when the hand recording means is manually moved, said guide member being portable and contactable with the recording medium;

a base member engageable with said guide member, said base member being portable and capable of sliding said guide member in predetermined intervals; and an engaging portion provided on and movable along said guide member for detachably engaging with said hand recording means, wherein said base member has a support section for slidably supporting said guide member at a constant pitch in a direction different from a moving direction of said engaging portion.

15. In combination, a movement guide and a hand recording device for recording onto a recording medium by manually moving along said movement guide, said movement guide having a guide member for guiding the hand recording device when the hand recording device is manually moved, said guide member being portable and contactable with the recording medium, a base member engageable with said guide member, said base member being portable and capable of sliding said guide member in predetermined intervals, and an engaging portion provided on and movable along said guide member for detachably engaging with said hand recording device, wherein said base member has a support section for slidably supporting said guide member at a constant pitch in a direction different from a moving direction of said engaging portion, said hand recording device comprising:

recording means for recording onto the recording medium; and an engaging portion provided on a body of said device for detachably engaging with the engaging portion of said movement guide.

* * * * *

UNITED STATES PATENT AND TRADEMARK OFFICE

CERTIFICATE OF CORRECTION

PATENT NO. : 5,650,820

DATED : July 22, 1997

INVENTOR(S) : Sekine et al.

It is certified that error appears in the above-identified patent and that said Letters Patent is hereby corrected as shown below:

On the title page item [56]:

FOREIGN PATENT DOCUMENTS

"5040289" 12/1975 Japan" should read --50-40289 12/1975 Japan--; and
"59-114074 6/1984 Japan" should read --59-114078 6/1984 Japan--.

COLUMN 3:

Line 19, "detect" should read --detects--.

COLUMN 4:

Line 33, "lo" should be deleted.

COLUMN 5:

Line 64, "will" should read --will be--.

COLUMN 6:

Line 38, "Alternatively" should read --Alternatively,--.

UNITED STATES PATENT AND TRADEMARK OFFICE

CERTIFICATE OF CORRECTION

PATENT NO. : 5,650,820

DATED : July 22, 1997

INVENTOR(S) : Sekine et al.

It is certified that error appears in the above-identified patent and that said Letters Patent is hereby corrected as shown below:

COLUMN 8:

Line 53, "the" (first occurrence) should read --be--.

Signed and Sealed this

First Day of September, 1998

*Attest:*

*Attesting Officer*

BRUCE LEHMAN

*Commissioner of Patents and Trademarks*